US010576747B2

(12) United States Patent
Kubota

(10) Patent No.: US 10,576,747 B2
(45) Date of Patent: Mar. 3, 2020

(54) INK JET HEAD MODULE

(71) Applicant: RISO KAGAKU CORPORATION, Tokyo (JP)

(72) Inventor: Mutsumi Kubota, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/203,147

(22) Filed: Nov. 28, 2018

(65) Prior Publication Data

US 2019/0160824 A1 May 30, 2019

(30) Foreign Application Priority Data

Nov. 29, 2017 (JP) ..... 2017-228648

(51) Int. Cl.

| | |
|---|---|
| ***B41J 2/175*** | (2006.01) |
| ***B41J 25/34*** | (2006.01) |
| ***B41J 2/165*** | (2006.01) |
| ***B41J 29/02*** | (2006.01) |

(52) U.S. Cl.

CPC ..... *B41J 2/17523* (2013.01); *B41J 2/165* (2013.01); *B41J 2/1752* (2013.01); *B41J 2/1753* (2013.01); *B41J 2/1755* (2013.01); *B41J 25/34* (2013.01); *B41J 29/02* (2013.01); *B41J 2202/20* (2013.01)

(58) Field of Classification Search

CPC . B41J 2/165; B41J 2/175; B41J 2/1752; B41J 2/17523; B41J 2/1753; B41J 2/17546; B41J 2/1755; B41J 25/34; B41J 29/02; B41J 2202/20

See application file for complete search history.

(56) References Cited

U.S. PATENT DOCUMENTS

| | | | | |
|---|---|---|---|---|
| 4,907,018 | A * | 3/1990 | Pinkerpell | B41J 2/1752 346/139 R |
| 5,550,570 | A * | 8/1996 | Kurata | B41J 2/1752 347/49 |
| 6,199,975 | B1 | 3/2001 | Baitz et al. | |
| 7,717,549 | B2 * | 5/2010 | Rademakers | B41J 2/17513 347/20 |
| 2001/0040610 | A1 | 11/2001 | Kurata et al. | |
| 2006/0274131 | A1 | 12/2006 | Noguchi et al. | |

(Continued)

FOREIGN PATENT DOCUMENTS

| | | |
|---|---|---|
| EP | 1726437 | 11/2006 |
| JP | 2012-051127 A | 3/2012 |

OTHER PUBLICATIONS

Extended European Search Report from European Patent Office (EPO) in European Patent Appl. No. 18207780.0, dated Apr. 3, 2019.

*Primary Examiner* — Anh T Vo

(74) *Attorney, Agent, or Firm* — Greenblum & Bernstein, P.L.C.

(57) ABSTRACT

The ink jet head module includes: at least one ink jet head that ejects ink; an ink path that supplies ink to the ink jet head; a joint for connecting the ink path and a fitting portion of a printing apparatus main body; a handle which is operated according to attachment and detachment of the ink jet head module to the printing apparatus main body; and a fitting mechanism that inserts and extracts the fitting portion of the printing apparatus main body into and out from the joint in response to movement of the handle.

8 Claims, 9 Drawing Sheets

(56) References Cited

U.S. PATENT DOCUMENTS

| | | | | |
|---|---|---|---|---|
| 2008/0018721 | A1 | 1/2008 | Umeda | |
| 2010/0026753 | A1 | 2/2010 | Kuroda et al. | |
| 2010/0302309 | A1* | 12/2010 | Hatta ..... | B41J 2/16511 347/32 |
| 2012/0050398 | A1 | 3/2012 | Yamagishi et al. | |

* cited by examiner

INK JET HEAD MODULE

CROSS-REFERENCE TO RELATED APPLICATIONS

The present application claims priority under 35 U.S.C. § 119 to Japanese Patent Application No. 2017-228648, filed on Nov. 29, 2017. The above application is hereby expressly incorporated by reference, in its entirety, into the present application.

BACKGROUND OF THE INVENTION

1. Field of the Invention

The present invention is related to an ink jet head module which is employed in an ink jet printing apparatus that performs printing by ejecting ink onto a print medium.

2. Description of the Related Art

Ink jet printing apparatuses that eject ink from an ink jet head to a print medium and perform printing while conveying a print medium such as paper or film have been conventionally proposed.

For example, Japanese Unexamined Patent Publication No. 2012-051127 proposes an ink jet printing apparatus in which a plurality of ink jet heads are arranged side by side in a head holder provided above a conveyor belt that conveys a print medium, and printing is performed by ejecting ink from the plurality of ink jet heads to the print medium.

SUMMARY OF THE INVENTION

However, when maintenance, such as replacement of an ink jet head, is performed on an ink jet printing apparatus having a plurality of ink jet heads as disclosed in Japanese Unexamined Patent Publication No. 2012-051127, if an ink tube that supplies ink is removed from each ink jet head, workability is poor, and such maintenance will require a long amount of time. In addition, there may be cases in which engagement failure will occur, depending on the operator who is performing the maintenance operation.

The present invention has been developed in view of the foregoing circumstances. It is an object of the present invention to provide an ink jet head module that facilitates maintenance operations such as replacement of an ink jet head and shortens the amount of time required for maintenance operations, thereby improving the serviceability of an ink jet printing apparatus that employs an ink jet head.

An ink jet head module according to the present invention is equipped with:

at least one ink jet head that ejects ink;

an ink path that supplies ink to the ink jet head;

a joint for connecting the ink path and a fitting portion of a printing apparatus main body;

an operation member which is operated according to attachment and detachment of the ink jet head module to the printing apparatus main body; and a fitting mechanism that inserts and extracts the fitting portion of the printing apparatus main body into and out from the joint in response to movement of the operation member.

The ink jet head module of the present invention is equipped with: at least one ink jet head that ejects ink; the ink path that supplies ink to the ink jet head; the joint for connecting the ink path and a fitting portion of the printing apparatus main body; the operation member which is operated according to attachment and detachment of the ink jet head module to the printing apparatus main body; and the fitting mechanism that inserts and extracts the joint and the fitting portion of the printing apparatus main body in response to movement of the operation member. Therefore, maintenance operations such as replacement of ink jet heads are facilitated, the amount of time required for maintenance work can be shortened. As a result, the serviceability of an ink jet printing apparatus can be improved.

In addition, by merely attaching and detaching the ink jet head module, the joint of the ink jet head module and the fitting portion can be positively fitted regardless of the level of skill of an operator.

DETAILED DESCRIPTION OF THE EMBODIMENTS

Figure 1:
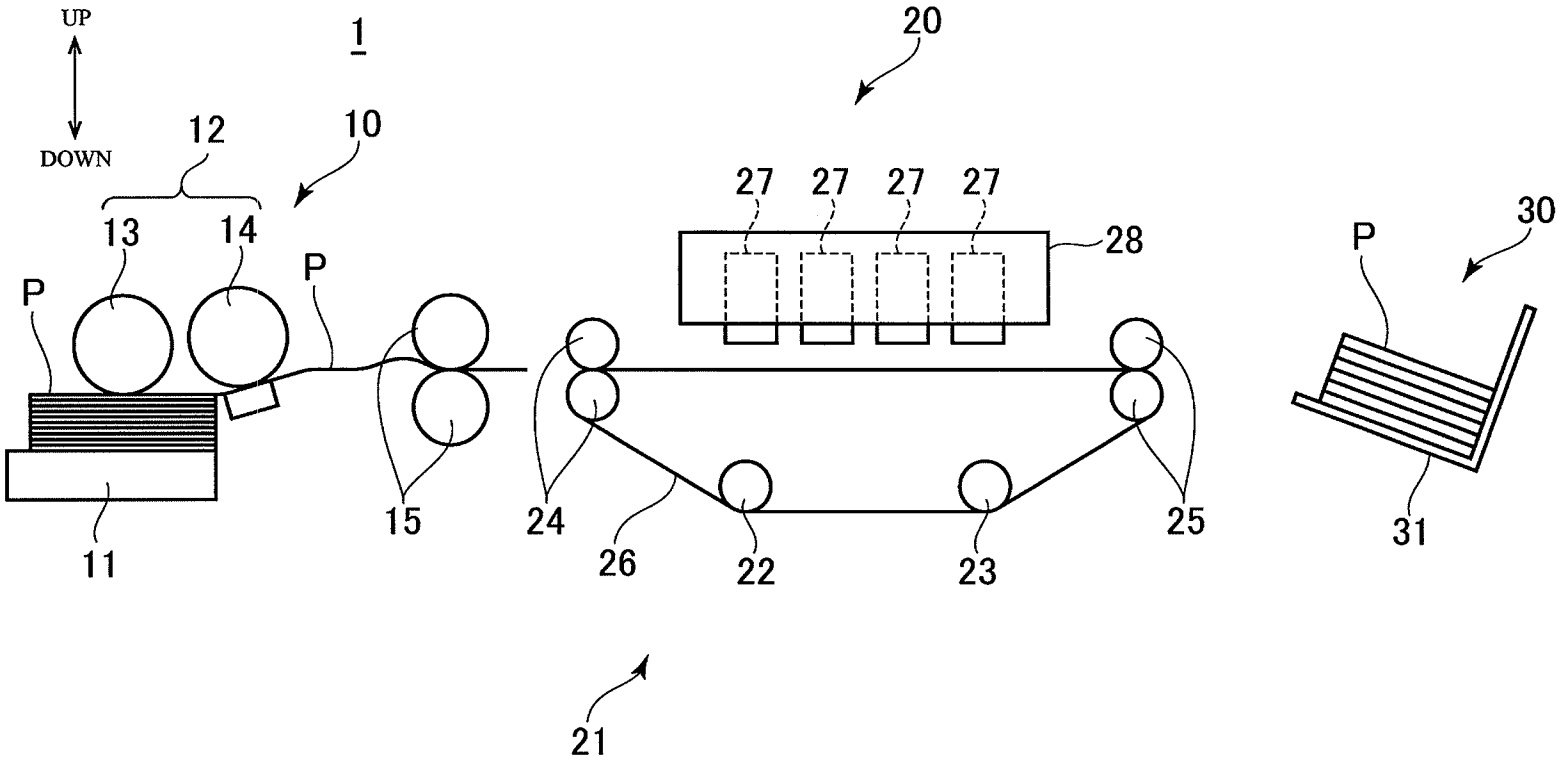
FIG. 1 is a diagram that illustrates the schematic configuration of an ink jet printing apparatus that employs an embodiment of an ink jet head module of the present invention.

Hereinafter, an ink jet printing apparatus that employs an embodiment of the ink jet head module of the present invention will be described in detail with reference to the attached drawings. The ink jet printing apparatus of the present embodiment is characterized by the configuration of an ink jet head module, in which a plurality of ink jet heads that eject ink are provided. First, the configuration of the entire ink jet printing apparatus will be described. FIG. 1 is a diagram that illustrates the schematic configuration of an ink jet printing apparatus 1 according to the present embodiment. The vertical direction indicated by the arrow in FIG. 1 is the vertical direction in the actual ink jet printing apparatus 1.

As illustrated in FIG. 1, the ink jet printing apparatus 1 of the present embodiment is equipped with a paper feeding unit 10, an image forming unit 20, and a paper discharge unit 30.

The sheet feeding unit 10 is equipped with a sheet feeding table 11 on which print media P such as paper or film are stacked, a primary paper supply roller 12 for feeding the print media P, which are stacked on the sheet feeding table 11, one by one from the topmost sheet toward a registration roller 15 to be described later such that the print media abuts the registration roller 15, and the registration roller 15 for delivering the print media P fed thereto by the primary paper supply roller 12 to the image forming portion 20, with a predetermined sheet interval therebetween.

The primary paper supply roller 12 includes a pickup roller 13 and a paper supply roller 14. The pickup roller 13 and the paper supply roller 14 rotate counterclockwise in FIG. 1, whereby the print media P which are fed out from the paper feed table 11 are conveyed to the registration rollers 15. After the leading end of a print medium P comes into contact with the registration roller 15, the registration roller 15 rotates at a preset timing, and the print medium P is conveyed toward the image forming unit 20.

The image forming unit 20 includes four ink jet head modules 27 and a conveyance mechanism 21.

Each of the ink jet head modules 27 ejects ink onto the print media P which are conveyed by the conveyance mechanism 21, to perform printing. As illustrated in FIG. 1, the four ink jet head modules 27 are arranged at predetermined intervals along the conveyance path of the print media P. The four ink jet head modules 27 respectively eject inks of different colors (black, cyan, magenta, and yellow, for example).

Figure 2A:
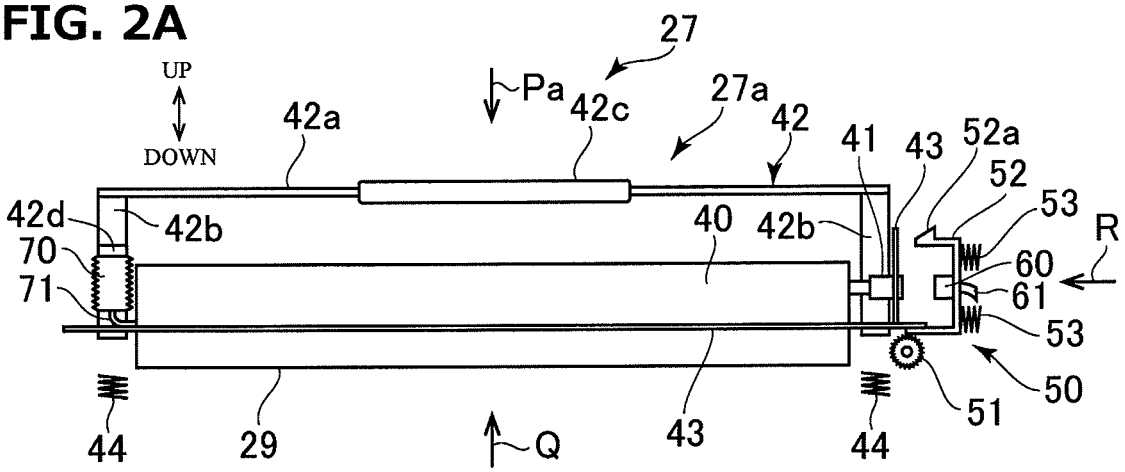
FIGS. 2A-2D are diagrams that illustrate the configuration of an embodiment of an ink jet head module.
Figure 2B:
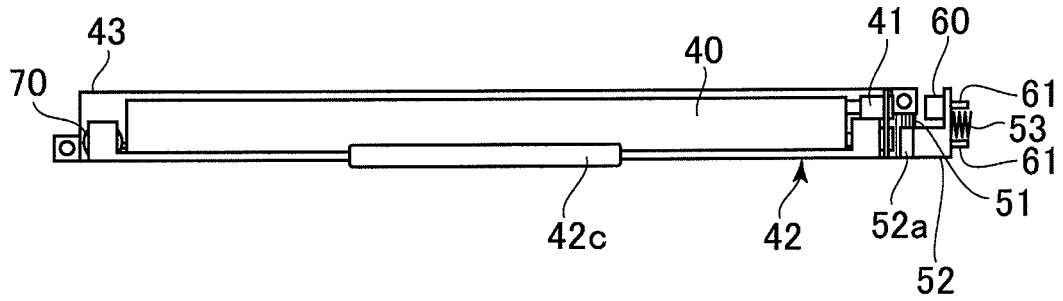
Figure 2C:
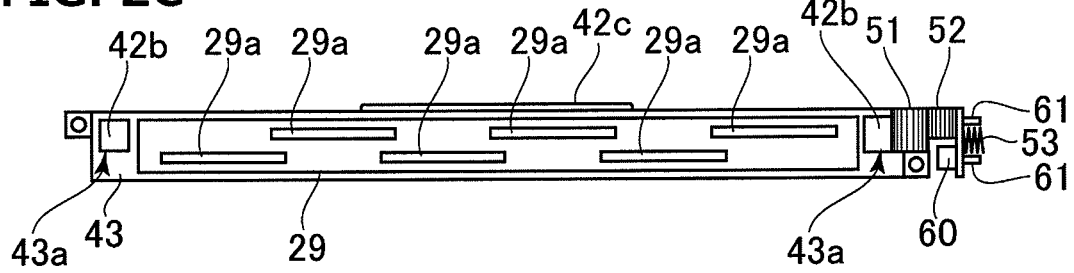
Figure 2D:
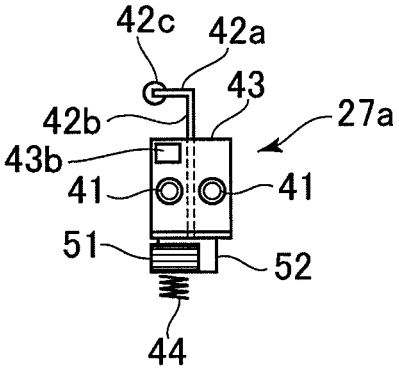

The four ink jet head modules 27 are installed in a head holder 28. FIGS. 2A through 2D are diagrams that illustrate the configuration of the ink jet head module 27. The upper and lower directions indicated by arrows in FIG. 2A indicate the vertical direction when the ink jet head module 27 is installed in the ink jet printing apparatus 1. FIG. 2A is a front view of the ink jet head module 27, FIG. 2B is a plan view of the ink jet head module 27 illustrated in FIG. 2A as viewed from the direction of arrow Pa, FIG. 2C is a bottom view of the ink jet head module 27 illustrated in FIG. 2A as viewed from the direction of arrow Q, and FIG. 2D is a side view of the ink jet head module 27 illustrated in FIG. 2A as viewed in the direction of arrow R. Note that FIG. 2D is a diagram from which a fitting portion support member 52 in the periphery of a fitting portion 60 to be described later is omitted.

The ink jet head module 27 includes an ink jet head module main body 27*a* which is detachably installed in the head holder 28, and a fitting mechanism 50 which is provided in the head holder 28.

The ink jet head module main body 27*a* includes a line head 29 and an ink path portion 40. The line head 29 and the ink path portion 40 are installed on a support member 43.

As illustrated in FIG. 2C, the line head 29 has two rows of head rows in which three ink jet heads 29 a are arranged at equal intervals in a direction orthogonal to the conveyance direction of the print medium P. The two rows of head rows are arranged in a zigzag formation such that the two rows of head rows overlap by a predetermined number of nozzles. That is, the ink jet head module main body 27*a* of the present embodiment is obtained by modularizing six ink jet heads 2*a*. By modularizing a plurality of ink jet heads 29*a* in this manner, it becomes possible to attach and detach a plurality of ink jet heads 29*a* integrally, so it becomes possible to save time and trouble of exchanging the ink jet heads 29*a*.

The ink path portion 40 has an ink path for supplying ink to the six ink jet heads 29*a*. A joint 41 that connects the ink path in the ink path portion 40 and the fitting portion 60 (corresponding to the fitting portion of the printing apparatus main body of the present invention) is provided at one end of the ink path portion 40.

An ink tube 61 is connected to the fitting portion 60. The ink tube 61 supplies ink which is stored in an ink tank (not shown) to the fitting portion 60. The ink which is supplied by the ink tube 61 is supplied to the ink path portion 40 via the fitting portion 60 and the joint 41. The joint 41 may be of any configuration as long as it is capable of being detachably connected to the fitting portion 60. It is preferable for a one touch joint with a check valve, or a joint which is closed by a solenoid valve at the moment that the joint 41 is disengaged from the fitting portion 60 to be employed. Thereby, when the fitting portion 60 is pulled out from the joint 41, it becomes possible to prevent ink from leaking from the joint 41. In the present embodiment, two joints 41 are provided for the support member 43, and correspondingly, two fitting portions 60 and two ink tubes 61 are provided, as illustrated in FIG. 2D.

Note that regarding the two joints 41, a configuration may be adopted in which ink is supplied to the two joints 41, or ink is supplied to one joint 41 and is taken out from the other joint 41 to circulate the ink between the ink tank and the ink jet head module main body 27*a*. In the case that a configuration that does not circulate the ink is adopted, one joint 41 may be provided.

In addition, the ink jet head module main body 27*a* is equipped with a handle 42 (corresponding to an operation member of the present invention). The handle 42 is a portion which is gripped when the user holds the ink jet head module main body 27*a*. The handle 42 is equipped with a handle main body 42*a* that extends in the length direction of the line head 29 as illustrated in FIG. 2A, and a handle main body support member 42*b* which is provided at the two ends of the grip handle body 42*a*. A grip portion 42*c* is formed at the center of the handle main body 42*a* such that a user can easily grip the handle 42. The grip portion 42*c* is formed, for example, by a columnar member whose cross sectional shape in a direction orthogonal to the length direction thereof is a circle or an ellipse.

The handle main body support member 42*b* is a member that extends in a direction perpendicular to the handle main body 42*a*. A passage aperture 43*a* (refer to FIG. 2C), through which the handle main body support member 42*b* passes, is formed in the support member 43 which is provided with the line head 29 and the ink path portion 40. The handle main body support member 42*b* is provided such that it is capable of sliding vertically within the passage aperture 43*a*. In addition, a pressure adjustment unit support portion 42*d*, for expanding and contracting a pressure adjustment unit 70 to be described later, is formed in the handle main body support member 42*b* at the side opposite the joint 41. The pressure adjustment unit support portion 42*d* moves in the vertical direction by the handle 42 moving in the vertical direction, and thereby the pressure adjustment unit 70 expands and contracts.

The pressure adjusting unit 70 is constituted by a bellows, for example, and is connected to the ink path of the ink path portion 40 by a pressure adjusting pipe 71. As described above, the pressure adjusting unit 70 expands and contracts as the handle 42 moves in the vertical direction, and thereby the pressure in the ink path of the ink path portion 40 is adjusted. The pressure adjustment unit 70 is not limited to being constituted by a bellows. Alternatively, a bag shaped or diaphragm shaped member or the like may be employed.

Further, a concavo convex portion 42*e* that engages with a circular gear 51 to be described later is formed on the handle main body support member 42*b* at the side of the joint 41 (refer to FIG. 7). The handle main body support member 42*b* at the side of the joint 41 and the circular gear 51 constitute a rack and pinion system.

A lower spring member 44 is respectively provided below the lower ends of each of the two handle main body support members 42*b*. When the lower spring members 44 are pushed and contracted by the lower ends of the two handle main body support members 42*b*, the lower spring members 44 urges and lifts the handle 42 upward. Details of this operation and the effects thereof will be described later. Note that the lower ends of the lower spring members 44 are connected to the bottom surface of the head holder 28.

Next, the fitting mechanism 50 will be described. As described above, the fitting mechanism 50 is installed in the head holder 28 and is equipped with the circular gear 51, a fitting portion support member 52, and a lateral spring member 53.

The circular gear 51 is provided at a position at which it is in contact with the handle main body support member 42*b* at the side of the joint 41 and the fitting portion support member 52. As described above, the rack and pinion system is constituted by the handle main body support member 42*b* at the side of the joint 41 and the circular gear 51. In addition, a rack and pinion system is constituted by the circular gear 51 and the fitting portion support member 52.

The fitting portion support member 52 is formed in a U shape, and a fitting portion 60 to which the ink tube 61 is connected is attached to the central portion of the fitting portion support member 52. A concavo convex portion 52*b* (refer to FIG. 7) that engages with the circular gear 51 is formed on a surface of a lower plate shaped portion of the fitting portion support member 52 which is in contact with the circular gear 51. A wedge shaped latch portion 52*a* which is fitted in a fitting aperture 43*b* (refer to FIG. 2D) formed in the support member 43 is formed on the upper surface of the end portion of an upper plate shaped portion of the fitting portion support member 52.

One end of the lateral spring member 53 is connected to the fitting portion support member 52, and the other end is connected to the head holder 28. Therefore, when the latch on the support member 43 by the latch portion 52*a* of the fitting portion support member 52 is released, the fitting portion support member 52 is pulled toward the head holder 28.

The operation of the fitting mechanism 50 will be described later in detail.

Figure 3:
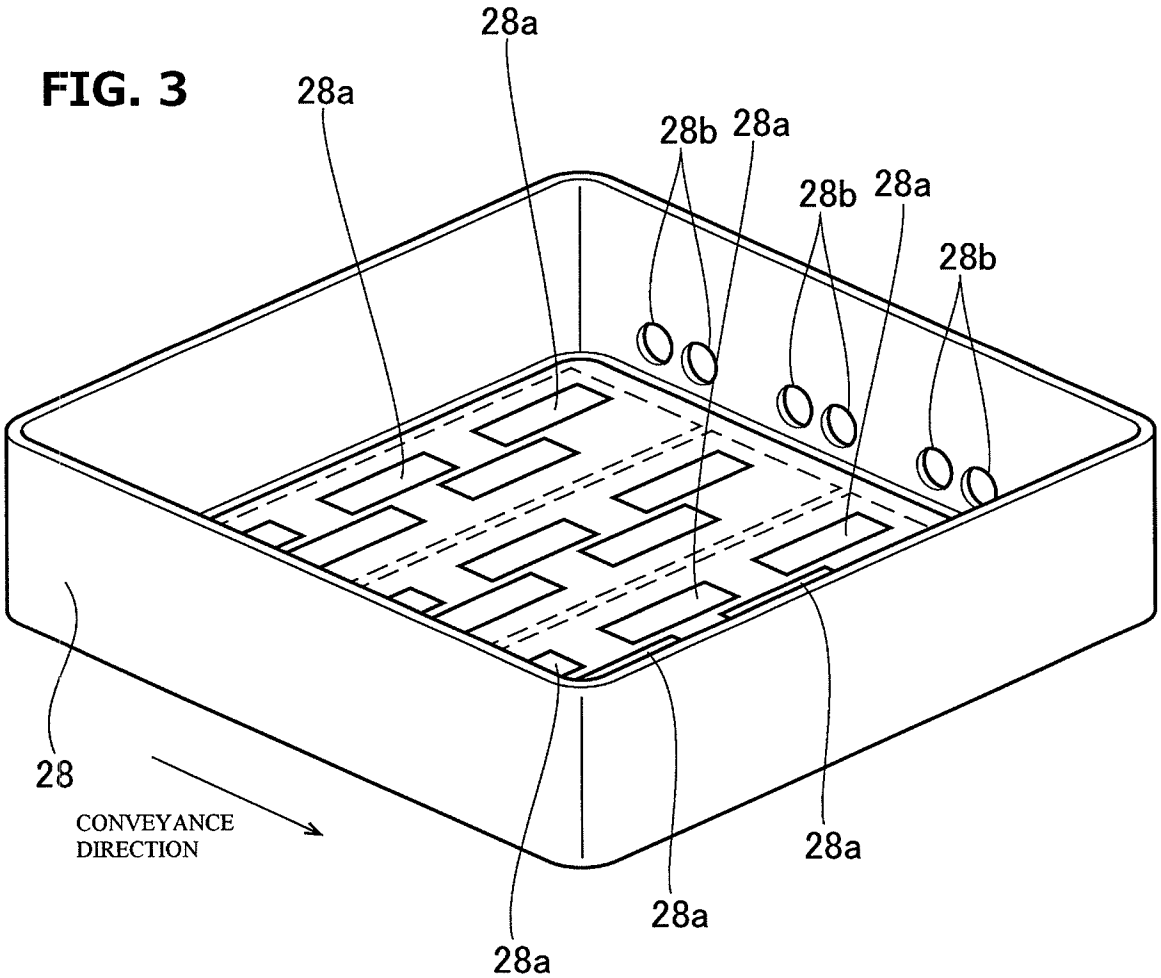
FIG. 3 is a perspective view of a head holder.
Figure 4:
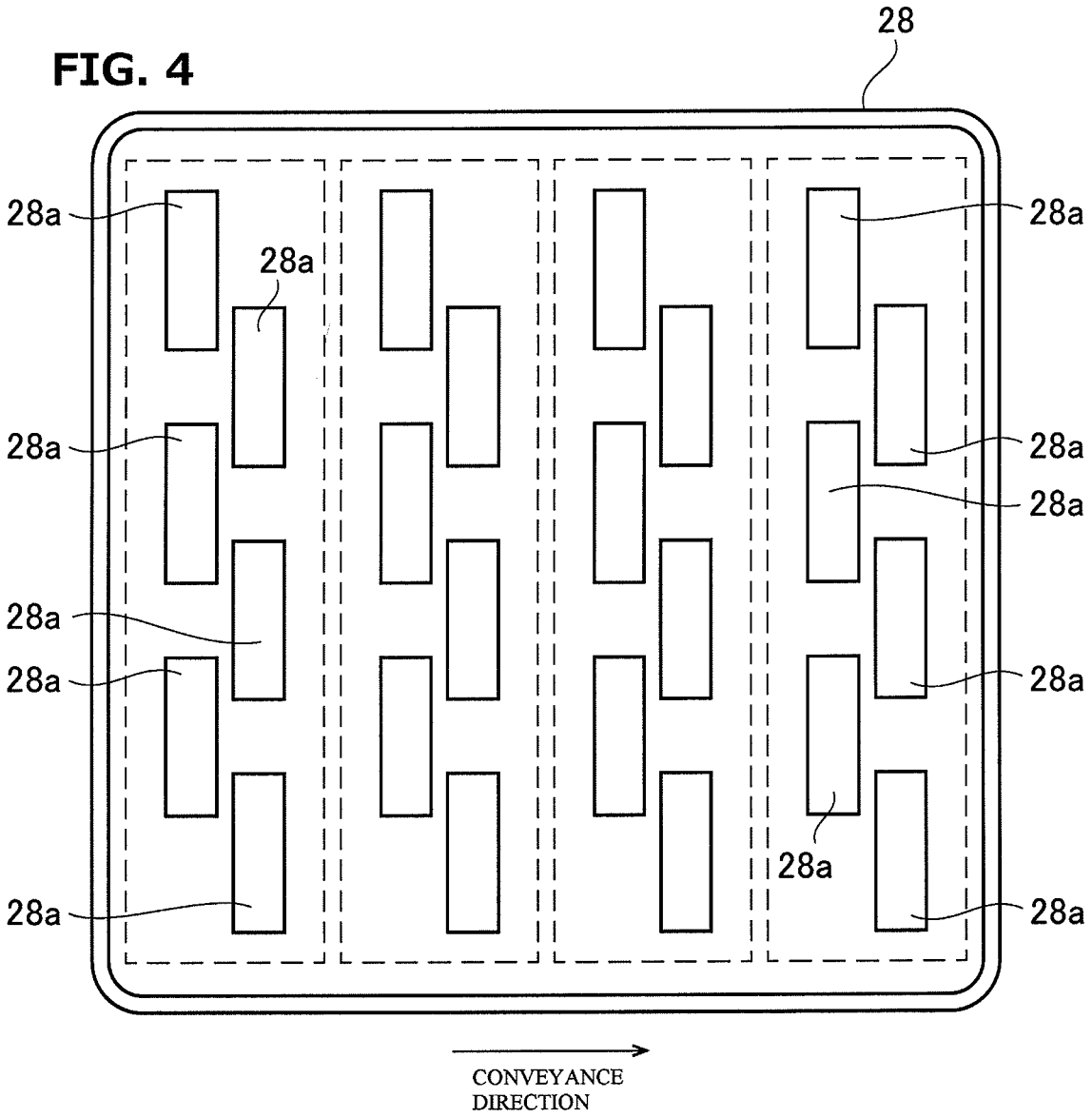
FIG. 4 is a plan view of the head holder.

Next, the head holder 28 will be described. FIG. 3 is a perspective view of the head holder 28 as seen obliquely from above, and FIG. 4 is a plan view of the head holder 28.

As illustrated in FIG. 3, the head holder 28 is constituted of a box shaped support member. A plurality of installation apertures 28*a*, into which each ink jet head 29*a* (refer to FIG. 4) of each ink jet head module main body 27*a* is fitted and installed, are formed in the bottom surface of the head holder 28. The installation apertures 28*a* are through holes and are formed so that the ink ejection surface of each ink jet head 29*a* is exposed at the exterior of the bottom surface of the head holder 28.

The four rectangles denoted by dotted lines in FIG. 3 indicate the range in which the installation apertures 28*a* in which the six ink jet heads 29*a* of each ink jet head module main body 27*a* are disposed. Six ink jet heads 29*a* of each ink jet head module main body 27*a* are respectively disposed in six installation apertures 28*a* within the rectangles indicated by the dotted lines. In addition, the aforementioned fitting mechanism 50 and the two lower spring members 44 corresponding to each ink jet head module main body 27*a* are provided within the head holder 28.

Further, as illustrated in FIG. 3, an ink tube aperture 28*b* is formed in one side surface of two side surfaces of the head holder 28 that extend in the conveyance direction of the print medium P. The ink tube aperture 28*b* is a through hole, in which the aforementioned ink tube 61 is disposed.

Returning to FIG. 1, the conveyance mechanism 21 is equipped with a conveyor belt 26, a drive roller 25, driven rollers 22, 23, 24, etc. The conveyance mechanism 21 conveys the print medium P, which is conveyed from the sheet feeding unit 10, attached to the conveyor belt 26 by suction while maintaining a constant speed. After printing is administered onto the print medium P by the ink jet head module 27, the conveyance mechanism 21 conveys the printed print medium P to the paper discharge unit 30.

The conveyor belt 26 is an annular endless belt wrapped around the driving roller 25 and the driven rollers 22, 23, 24. The conveyor belt 26 is made of a material such as rubber or resin which has plasticity and generates an appropriate frictional force with the print medium P. The driven rollers 22, 23, and 24 support the conveyor belt 26 together with the drive roller 25, and are driven by the drive roller 25 via the conveyor belt 26.

The paper discharge unit 30 is equipped with a paper discharge tray 31, and sequentially stocks the printed print medium P, on which printing has been performed in the image forming unit 20, on the paper discharge tray 31.

Next, the operation of the ink jet head module 27 which is installed in the ink jet printing apparatus 1 described above will be described with reference to FIGS. 5 through 7. FIGS. 5A-6D are diagrams for explaining the operation of each mechanism in the flow from attachment to detachment of the ink jet head module main body 27*a*, and FIG. 7 is a partially enlarged view for explaining the operation of the fitting mechanism 50.

Figure 5A:
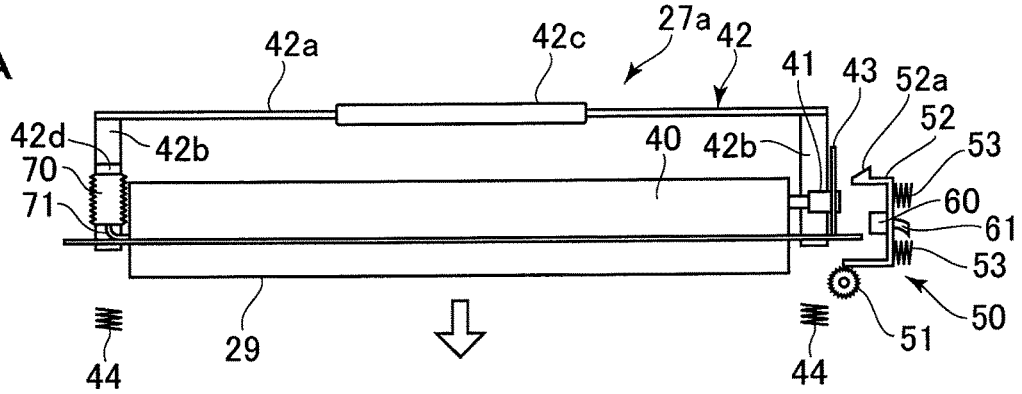
FIGS. 5A-5D are a collection of diagrams for explaining the operation of each mechanism associated with mounting an ink jet head module main body.

First, an ink jet head module main body 27*a*, which has undergone maintenance such as replacement of the ink jet head 29*a*, is placed in the head holder 28 of the main body of the ink jet printing apparatus 1, as illustrated in FIG. 5A.

Figure 5B:
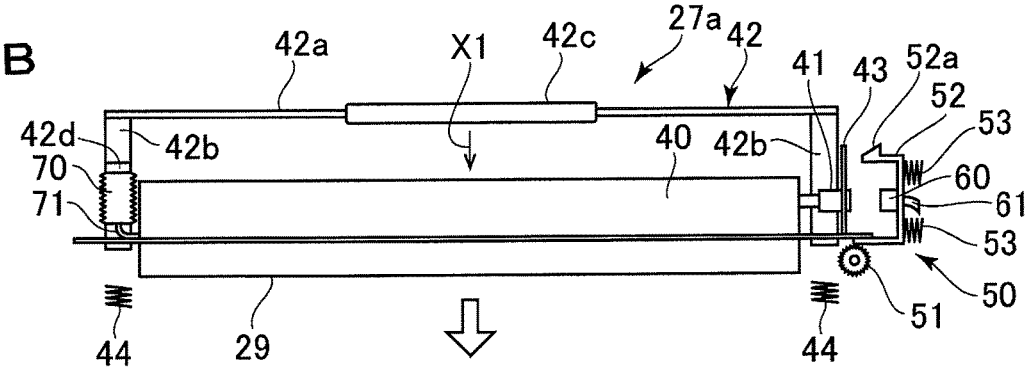

Then, the ink jet head module main body 27*a* is inserted into the head holder 28 until the support member 43 of the ink jet head module main body 27*a* is at the position of the lower plate shaped portion of the fitting portion support member 52 provided within the head holder 28, as illustrated in FIG. 5B. The handle 42 is pressed downward (the direction of arrow X1) by a hand of a user in a state in which the ink jet head module main body 27*a* is installed and fixed at this position.

Figure 5C:
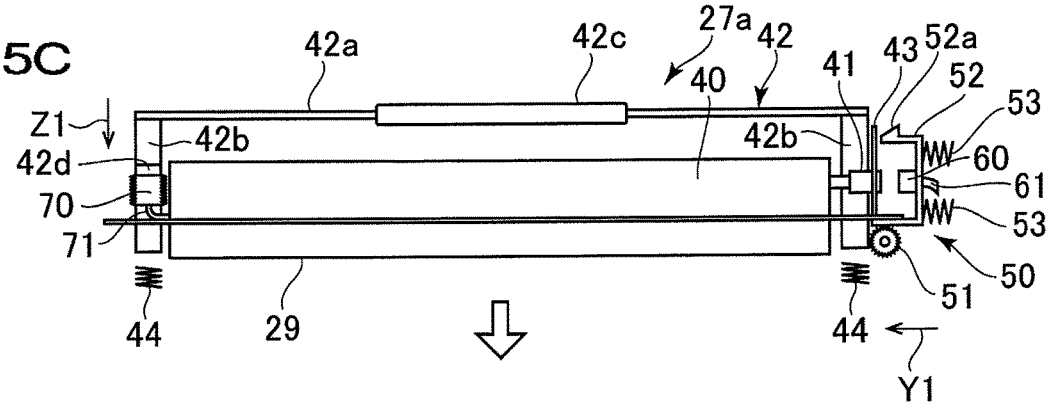
Figure 7A:
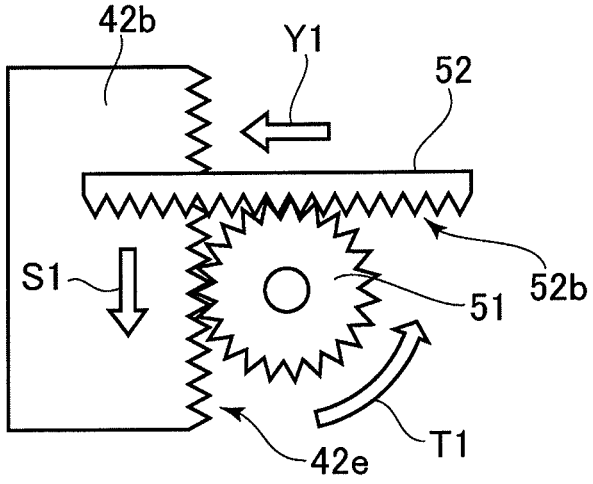
FIGS. 7A and 7B are partially enlarged views for explaining the operation of a fitting mechanism.

Next, in the case that the handle 42 is pushed down to a position where the handle main body support member 42*b* comes into contact with the circular gear 51 as illustrated in FIG. 5C, the concavo convex portion 42*e* formed on the handle main boy support member 42*b* engages with the circular gear 51 as illustrated in FIG. 7A. As the handle main body support member 42*b* continues to be pressed downward (the direction of arrow S1), the circular gear 51 rotates in the counterclockwise direction in FIG. 7A (the direction of arrow T1). In accordance with the rotation of the circular gear 51, the fitting portion support member 52 having the concavo convex portion 52*b* that engages with the circular gear 51 moves toward the left direction in FIG. 5C and FIG. 7A (the direction of arrow Y1). That is, the fitting portion 60 which is provided on the fitting portion support member 52 moves to the side of the joint 41 of the ink jet head module main body 27*a*.

In addition, the pressure adjustment portion support portion 42*d* also moves downward (the direction of arrow Z1) by the handle 42 being pressed downward as illustrated in FIG. 5C, thereby compressing the pressure adjustment unit 70. In the case that the pressure adjusting unit 70 is compressed, the interior of the ink path of the ink path portion 40 is pressurized. Thereby, clogged thickened ink and air bubbles at the tip of the nozzle of the ink jet head 29*a* are ejected. Therefore, it is not necessary to perform a separate ejection operation, and printing efficiency can be improved.

Then, when the handle 42 is pressed down further from the position illustrated in FIG. 5C, the fitting portion support member 52 moves further toward the left direction (the direction of arrow Y1) and insertion of the fitting portion 60 into the joint 41 of the ink jet head module main body 27 begins.

Figure 5D:
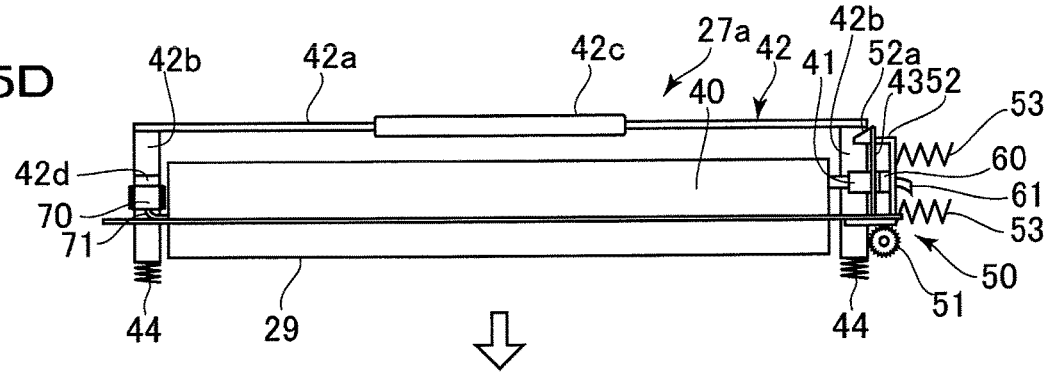

Next, when the handle 42 is pressed down further, insertion of the fitting portion 60 into the joint 41 is completed, as illustrated in FIG. 5D. At this time, the latch portion 52*a* which is provided on the fitting portion support member 52 engages and becomes latched in the fitting aperture 43*b* formed in the support member 43. Thereby, the fitting portion support member 52 can be automatically fixed to the ink jet head module main body 27*a*. That is, the connection between the joint 41 of the ink jet head module main body 27*a* and the fitting portion 60 can be automatically fixed. In a state in which the latch portion 52*a* is engaged and latched in the fitting aperture 43*b* of the support member 43, the lower end of the handle main body support member 42*b* abuts against the lower spring members 44, as illustrated in FIG. 5D. However, the elastic force of the lower spring member 44 is not imparted onto the handle main body supporting member 42*b*.

The above was a description of the operation of each mechanism when attaching the ink jet head module main body 27*a* to the head holder 28 (ink jet printing apparatus main body).

Next, the operation of each mechanism when detaching the ink jet head module main body 27*a* from the head holder 28 (ink jet printing apparatus main body) will be described.

Figure 6A:
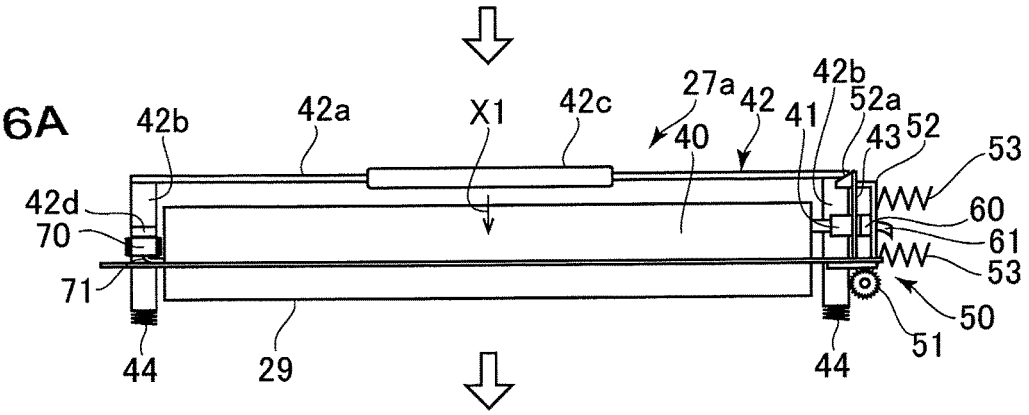
FIGS. 6A-6D are diagrams for explaining the operation of each mechanism associated with detaching the ink jet head module main body.

When detaching the ink jet head module main body 27*a* from the head holder 28, the handle 42 is pressed further downward (in the direction of the arrow X1) from the state illustrated in FIG. 6A. Thereby, the handle main body support member 42*b* compresses the lower spring members 44, and the latch portion 52*a* is pressed downward by the end portion of the handle main body 42*a*. Note that the plate shaped portion of the fitting portion support member 52 on which the latch portion 52*a* is provided is formed of a material having flexibility, and the latch portion 52*a* is pressed downward by deformation of the plate shaped portion.

Then, when the user releases their hand from the handle 42, the elastic force of the lower spring members 44 act on the handle main body support member 42*b*, and thereby the handle 42 moves so as to jump out in the upward direction (the direction of arrow X2). Simultaneously with the movement of the handle 42, the fitting portion support member 52 is pulled in the rightward direction (the direction of arrow Y2) by the lateral spring member 53, such that the engagement of the latch portion 52*a* with the support member 43 is released, and the ink jet head module 27 becomes in the state illustrated in FIG. 6B.

Figure 6B:
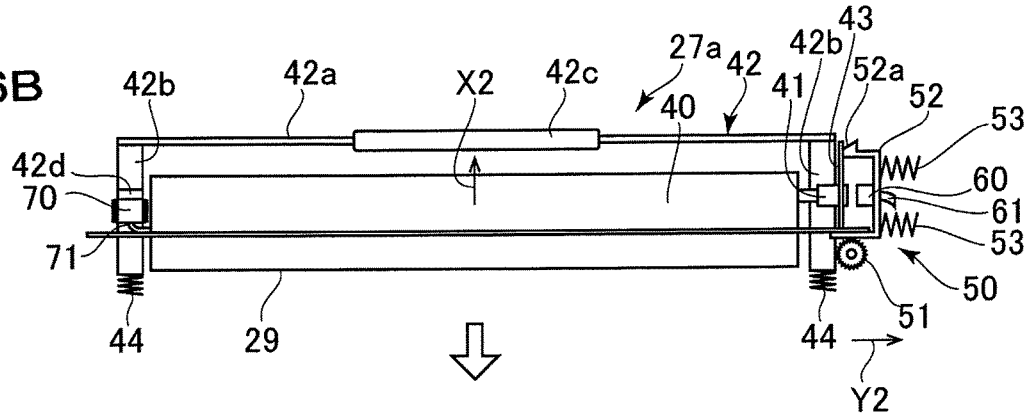
Figure 6C:
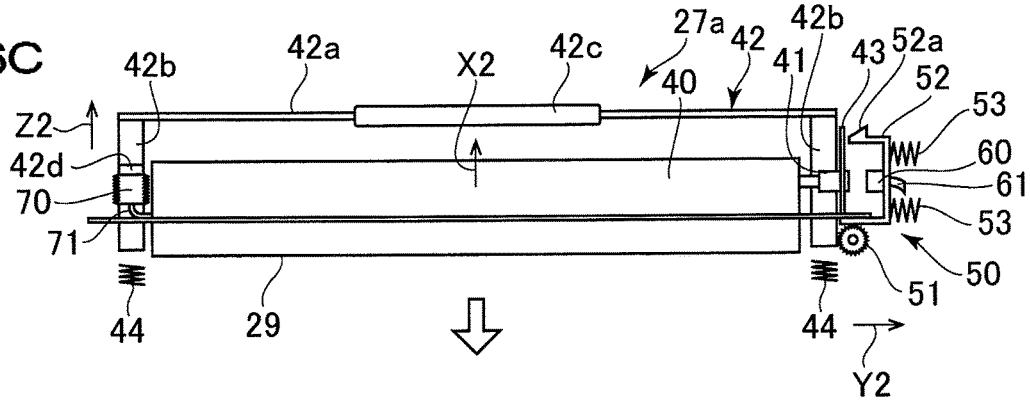
Figure 7B:
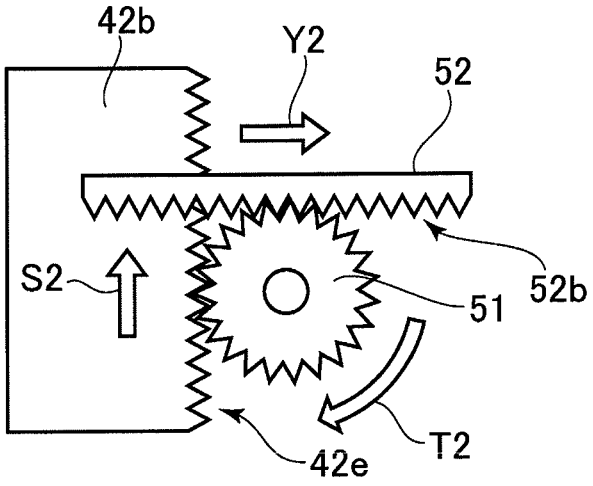

Next, as illustrated in FIG. 6C, when the handle 42 is lifted upward (the direction of arrow X2) from the state illustrated in FIG. 6B, the handle main body support member 42*b* moves upward (the direction of arrow S2) and the circular gear 51 rotates in the clockwise direction (the direction of arrow T2) of FIG. 7B resulting in the fitting portion support member 52 moving further in the rightward direction (the direction of arrow Y2) as illustrated in FIG. 7B, and the fitting portion 60 is extracted from the joint 41.

At this time, the pressure adjustment unit support portion 42*d* of the handle 42 also moves upward (the direction of the arrow Z2), such that the upper surface of the pressure adjustment unit 70 is also lifted, and the pressure adjustment unit 70 expands. Thereby, a negative pressure is generated in the ink path of the ink path portion 40. By causing the pressure within the ink path to become negative, it becomes possible to prevent ink from leaking from the nozzle of the ink jet head 29*a* of the ink jet head module main body 27*a*.

Figure 6D:
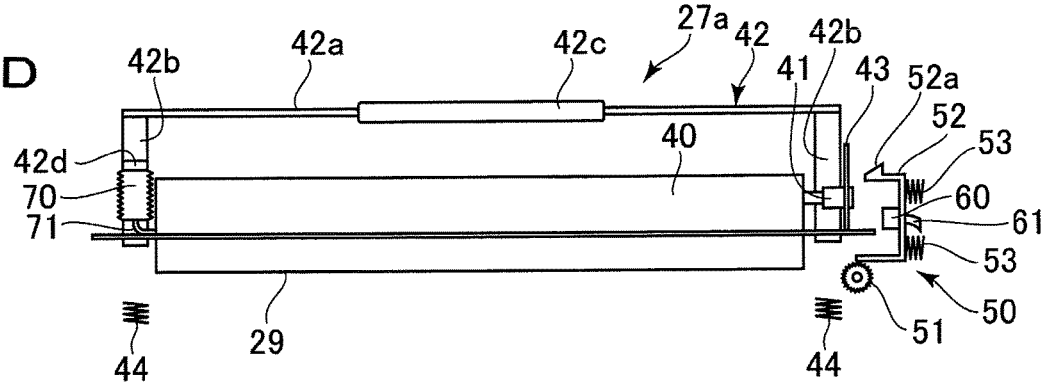

The handle 42 is lifted until the lower end of the handle main body support member 42*b* moves to the fixing position of the bottom surface of the support member 43, as illustrated in FIG. 6D. Thereafter, the ink jet head module main body 27*a* is taken out from the head holder 28. The ink jet head module main body 27*a* which is taken out from the head holder 28 undergoes necessary maintenance such as replacement of the ink jet head 29*a*.

The ink jet head module 27 of the embodiment described above is equipped with a plurality of ink jet heads 29*a* that eject ink, an ink path portion 40 for supplying ink to the plurality of ink jet heads 29*a*, a joint 41 that connects the ink path portion 40 and the fitting portion 60 of the ink jet printing apparatus main body, a handle 42 which is operated according to attachment and detachment of the ink jet head module 27 to and from the ink jet printing apparatus main body, and a fitting mechanism 50 that inserts and extracts the fitting portion 60 into and out from the joint 41 in response to movement of the handle 42. Therefore, it is possible to easily carry out maintenance operations such as replacement of the ink jet head 29*a* as well as to shorten the amount of time required for such work. As a result, the serviceability of the ink jet printing apparatus can be improved.

In addition, it is possible to positively fit the joint 41 of the ink jet head module 27 and the fitting portion 60 simply by performing the attaching/detaching operations of the ink jet head module 27 regardless of the skill of the operator.

In addition, in the ink jet head module 27 of the present embodiment, since the fitting portion 60 is inserted into and extracted from the joint 41 in response to the movement of the handle 42, the insertion/extraction operations of the fitting portion 60 can be performed in the workflow of setting the ink jet head module main body 27*a* on the head holder 28 or removing the ink jet head module main body 27*a* from the head holder 28, so that the work can be further facilitated.

Note that the fitting portion 60 may be configured to be inserted into and extracted from the joint 41 in response to movement of an operation member operated by users other than the handle 42. That is, the operation member is not limited to the handle 42. For example, an operation member for operating the fitting mechanism 50 may be provided separately from the handle 42.

Further, in the ink jet head module 27 of the embodiment described above, since the fitting mechanism 50 employs the rack and pinion system, it is possible to realize insertion and extraction of the fitting portion 60 into and from the joint 41 with a simpler configuration.

However, the configuration of the fitting mechanism 50 is not limited to the rack and pinion system, and any other configuration may be adopted as long as the fitting portion 60 is inserted into and extracted from the joint 41 in response to the movement of the handle 42. Specifically, the fitting portion support member 52 may be configured to be rotatable about a rotational axis 90 and a lower spring member 91 may be provided on the lower surface of the lower plate shaped portion of the fitting portion support member 52 as illustrated in FIGS. 8A and 8B, for example.

Figure 8A:
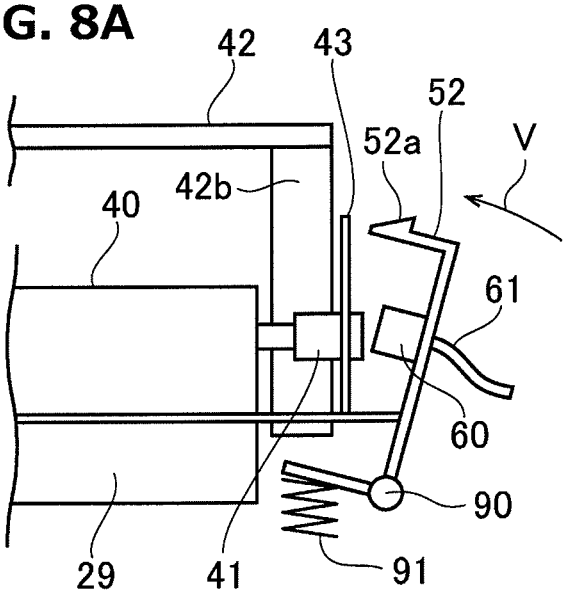
FIGS. 8A and 8B are diagrams that illustrate another embodiment of the fitting mechanism.
Figure 8B:
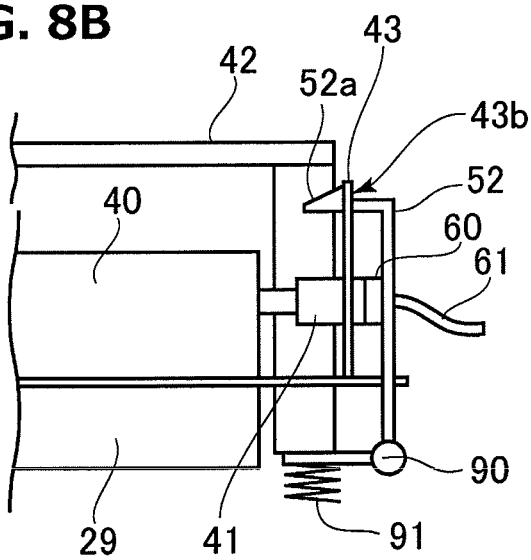

When the handle 42 is pressed downward from the state illustrated in FIG. 8A, the lower end of the handle main body support member 42*b* abuts against the lower plate shaped portion of the fitting portion support member 52. In the case that the handle 42 is pressed further downward, the fitting portion support member 52 rotates about the rotation axis 90 in the direction of the arrow V in FIG. 8A. Then, as illustrated in FIG. 8B, the fitting portion 60 is inserted into the joint 41 by rotation of the fitting portion support member 52, and the latch portion 52*a* engages with and becomes latched in the fitting aperture 43*b* which is formed in the support member 43.

When the ink jet head module main body 27*a* is removed, the handle 42 is pushed downward, causing the lower spring member 91 to be compressed by the handle main body support member 42*b*. In addition, and the latch portion 52*a* is pressed downward by the end of the handle main body 42*a*.

When the user releases their hand from the handle 42, the elastic force of the lower spring member 91 acts on the handle main body support member 42*b*, causing the handle 42 to move so as to jump out in the upward direction (the direction of arrow X2). Simultaneously with the movement of the handle 42, the fitting portion support member 52 rotates in the direction opposite to the direction of the arrow V due to its own weight, causing the engagement of the latch portion 52*a* with the support member 43 to be released, and the fitting portion 60 is extracted from the joint 41 to the state illustrated in FIG. 8A, which is a state in which the ink jet head module main body 27*a* is capable of being removed from the head holder 28.

Figure 9:
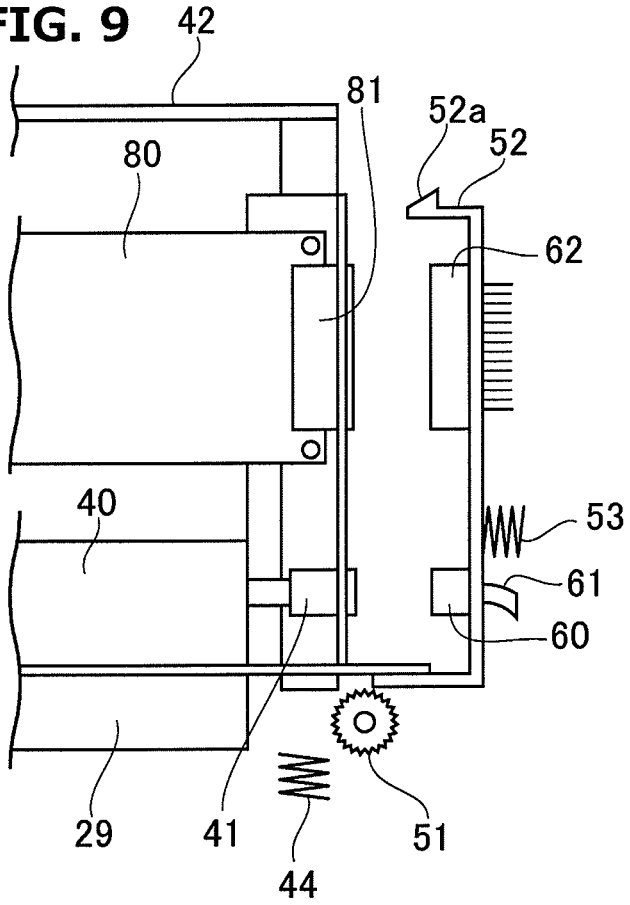
FIG. 9 is a diagram that illustrates the configuration of another embodiment of the ink jet head module of the present invention.

Further, the ink jet head module 27 of the embodiment described above may be further equipped with a control circuit board 80 for controlling ink ejection from each ink jet head 29*a*, as illustrated in FIG. 9. In the case that the control board 80 is provided in this manner, a module side connector 81 may be provided aligned with respect to the joint 41 in the vertical direction, and a main body side connector 62 may be provided aligned with respect to the fitting portion 60 in the vertical direction on the fitting portion support member 52. Thereby, the fitting portion 60 may be inserted into and extracted from the joint 41, and the module side connector 81 and the main body side connector 62 may be connected and disconnected in response to vertical movement of the handle 42.

Thereby, the module side connector 81 of the control board 80 and the main body side connector 62 of the ink jet printing apparatus main body side can be automatically connected and disconnected in response to attachment of the ink jet head module main body 27*a*, and it will become possible to reduce the work of a user. Note that the wiring connected to the main body side connector 62 is connected to a control unit including a CPU or the like of the ink jet printing apparatus main body. The other components are the same as those of the ink jet head module 27 of the previously described embodiment.

Regarding the ink jet head module of the present invention, the following additional items will be disclosed.

(Additional Items)

In the ink jet head module of the present invention, the fitting mechanism may have a rack and pinion system, and the fitting portion may move in the insertion and extraction directions by the fitting mechanism being operated in response to the movement of the operation member.

The ink jet head module of the present invention may be further equipped with a control circuit board for controlling ink ejection from each ink jet head and a module side connector that connects the control circuit board and a main body side connector of the printing apparatus main body. The fitting mechanism may insert and extract the joint into and out from the fitting portion of the printing apparatus main body, and the module side connector and the main body side connector may be connected and disconnected in response to movement of the operation member.

The ink jet head module of the present invention may be equipped with a pressure adjustment unit for adjusting pressure in the ink path, and the pressure adjustment unit operates in response to the movement of the operation member, whereby the pressure in the ink path is adjusted.

In the ink jet head module of the present invention, the operation member may be a handle of the ink jet head module.

EXPLANATION OF THE REFERENCE NUMERALS

1 ink jet printing apparatus
10 sheet feeding unit
11 sheet feeding table
12 primary paper supply roller
13 pickup roller
14 paper supply roller
15 registration rollers
20 image forming unit
21 conveyance mechanism
25 drive roller
22, 23, 24 driven rollers
26 conveyor belt
27 ink jet head module
27*a* ink jet head module main body
28 head holder
28*a* installation apertures
28*b* ink tube aperture
29 line head
29*a* ink jet head
30 paper discharge unit
31 paper discharge tray
40 ink path portion
41 joint
42 handle
42*a* handle main body
42*b* handle main body support member
42*c* grip portion
42*d* pressure adjustment unit support portion
42*e* concavo convex portion
43 support member
43*a* passage aperture
43*b* fitting aperture
44 lower spring members
50 fitting mechanism
51 circular gear
52 fitting portion support member
52*a* latch portion
52*b* concavo convex portion
53 lateral spring member
60 fitting portion
61 ink tube
62 main body side connector
70 pressure adjustment unit
71 pressure adjusting pipe
80 control circuit board
81 module side connector
90 rotational axis
91 lower spring member
P print medium

What is claimed is:

1. An ink jet head module, comprising:
at least one ink jet head that ejects ink;
an ink path that supplies ink to the ink jet head;

a joint for connecting the ink path and a fitting portion of a printing apparatus main body such that the ink jet head module is capable of being attached to and detached from the printing apparatus main body;

an operation member which is operated by a user when attaching or detaching the ink jet head module to or from the printing apparatus main body; and a fitting mechanism that inserts and extracts the fitting portion of the printing apparatus main body into and out from the joint in response to movement of the operation member when attaching or detaching the ink jet head module to or from the printing apparatus main body.

2. An ink jet head module as defined in claim 1, wherein:

the fitting mechanism comprises a rack and pinion system; and the fitting portion moves in the insertion and extraction directions by the fitting mechanism being operated in response to movement of the operation member.

3. An ink jet head module as defined in claim 1, further comprising:

a control circuit board for controlling ink ejection from each ink jet head; and a module side connector that connects the control circuit board and a main body side connector of the printing apparatus main body, wherein:

the fitting mechanism inserts and extracts the joint into and out from the fitting portion of the printing apparatus main body, and the module side connector and the main body side connector are connected and disconnected in response to movement of the operation member.

4. An ink jet head module as defined in claim 1, further comprising:

a pressure adjustment unit for adjusting pressure in the ink path, wherein:

the pressure adjustment unit operates in response to the movement of the operation member, to increase and decrease the pressure in the ink path.

5. An ink jet head module as defined in claim 1, wherein:

the operation member is a handle of the ink jet head module.

6. An ink jet head module as defined in claim 1, wherein the ink jet head module is detachable from or attachable to a head holder of the printing apparatus main body, the head holder of the printing apparatus main body includes the fitting portion, the joint is for connecting the ink path and the fitting portion, thereby securely attaching the ink jet head module to the head holder of the printing apparatus main body after the ink jet head module is placed in the head holder, and the operation member is connected to the joint and the movement of the operation member causes the joint to align with the fitting portion and begins a process of securely attaching the ink jet head module to the printing apparatus main body.

7. An ink jet head module as defined in claim 1, wherein the joint is for connecting the ink path and a latch of the fitting portion of the printing apparatus main body, wherein the ink jet head module further comprises:

a pressure adjustment portion; and a pressure adjustment unit connected to the interior of the ink path, and wherein the operation member comprises a manual handle which a) when pressed downward by the user initially compresses the pressure adjustment unit with the pressure adjustment portion, thereby pressurizing air in the ink path and ejecting ink and air from the ink jet head, b) when pressed further downward by the user, moves the fitting mechanism to move the latch of the fitting portion into the joint, thereby securely attaching the ink jet head module to the printing apparatus main body, and c) when moved upward after operations a) and b), moves the fitting mechanism to move the latch of the fitting portion out of the joint, and when moved further upward decompresses the pressure adjustment unit with the pressure adjustment portion, thereby depressurizing air in the ink path and preventing ink from leaking from the ink jet head.

8. A printing apparatus comprising an ink jet head module, the ink jet head module comprising:

at least one ink jet head that ejects ink;

an ink path that supplies ink to the ink jet head;

a joint for connecting the ink path and a fitting portion of a printing apparatus main body;

a handle which is operated according to attachment and detachment of the ink jet head module to and from the printing apparatus main body; and a fitting mechanism that is configured to insert and extract the fitting portion of the printing apparatus main body into and out from the joint in response to movement of the handle, wherein the fitting mechanism comprises a rack and pinion system, the rack and pinion system comprises a circular gear and a handle main body support member of the handle at the side of the joint and in contact with the circular gear, and the rack and pinion system further comprises a fitting portion support member of the fitting portion in contact with the circular gear in such a way that the fitting portion moves in the insertion and extraction directions by the fitting mechanism being operated in response to movement of the handle.

* * * * *